US008282140B1

(12) United States Patent
Joy

(10) Patent No.: US 8,282,140 B1
(45) Date of Patent: Oct. 9, 2012

(54) HIDDEN LOCKING MECHANISM FOR FURNITURE

(76) Inventor: Heather L. Joy, Glenpool, OK (US)

( * ) Notice: Subject to any disclaimer, the term of this patent is extended or adjusted under 35 U.S.C. 154(b) by 312 days.

(21) Appl. No.: 12/574,298

(22) Filed: Oct. 6, 2009

(51) Int. Cl.
*E05C 19/10* (2006.01)
*E05C 3/06* (2006.01)

(52) U.S. Cl. .... 292/97; 292/196; 292/119; 292/DIG. 11

(58) Field of Classification Search ..... 292/63, 292/67, 95, 113, 66, 97, 100, 108, 114, 194, 292/196, 200, 207, 210, 240–242, 278, 41, 292/53, 86, 119, 127, 135, 166, 168, 174, 292/221, 227, 237, DIG. 11, DIG. 49, DIG. 50; 312/204, 287, 315, 327; 220/315; 109/23, 109/53, 54, 58.5, 59 R, 64, 67
See application file for complete search history.

(56) References Cited

U.S. PATENT DOCUMENTS

| | | | | | |
|---|---|---|---|---|---|
| 431,325 | A * | 7/1890 | Brewer | 292/119 |
| 928,992 | A * | 7/1909 | Merrill | 292/119 |
| 1,138,516 | A * | 5/1915 | Vesper | 292/122 |
| 1,160,105 | A * | 11/1915 | Bodenstein | 292/27 |
| 1,528,618 | A * | 3/1925 | Knaster | 312/204 |
| 1,531,090 | A * | 3/1925 | Gilbert | 292/99 |
| 2,115,947 | A * | 5/1938 | Whitfield | 312/199 |
| 2,557,670 | A * | 6/1951 | Luft | 70/72 |
| 2,943,693 | A * | 7/1960 | Norrie | 180/89.14 |
| 3,035,862 | A * | 5/1962 | Phelps | 292/302 |
| 3,109,686 | A * | 11/1963 | Watts et al. | 312/215 |
| 3,129,955 | A * | 4/1964 | Hassell | 280/145 |
| 3,145,040 | A * | 8/1964 | Phelps | 292/304 |
| 3,150,902 | A * | 9/1964 | Naab et al. | 312/217 |
| 3,215,262 | A * | 11/1965 | Fernandez et al. | 206/1.5 |
| 3,238,003 | A * | 3/1966 | Stark | 312/219 |
| 3,357,762 | A * | 12/1967 | Forsyth | 312/215 |
| 3,893,721 | A * | 7/1975 | Upton | 292/30 |
| 5,042,853 | A * | 8/1991 | Gleason et al. | 292/126 |
| 5,067,938 | A * | 11/1991 | Uchida et al. | 494/12 |
| 6,079,585 | A * | 6/2000 | Lentini | 220/324 |
| 6,334,560 | B1 * | 1/2002 | Lentini | 224/404 |
| 6,540,268 | B2 * | 4/2003 | Pauser | 292/48 |

* cited by examiner

*Primary Examiner* — Carlos Lugo
*Assistant Examiner* — Alyson M Merlino
(74) *Attorney, Agent, or Firm* — Molly D. McKay

(57) ABSTRACT

The present invention relates to a hidden locking mechanism for furniture that includes a pivoting locking bar that locks and unlocks a lid of the furniture in response to the horizontal movement of a sliding leg provided on the furniture that is attached to one end of the locking bar. When viewed from outside the furniture, the bar is not visible and the leg appears to be fixed and unmovable so that it is not obvious how to unlock the lid of the furniture.

6 Claims, 4 Drawing Sheets

HIDDEN LOCKING MECHANISM FOR FURNITURE

BACKGROUND OF THE INVENTION

1. Field of the Invention

The present invention relates to a hidden locking mechanism for furniture that includes a pivoting locking bar that locks and unlocks a lid of the furniture in response to the horizontal movement of a sliding leg provided on the furniture. When viewed from outside the furniture, the bar is not visible and the leg appears to be fixed and unmovable so that it is not obvious how to unlock the lid of the furniture.

2. Description of the Related Art

Furniture pieces that include a compartment for storing items often are provided with a lock so that the compartment cannot be opened by unauthorized persons, thereby protecting the contents of the compartment from theft or unwanted access. Normally the lock employed is either a keyed lock or a combination lock.

The problem with the use of a keyed lock is that the key can become misplaced or damaged so that it is not available when access to the compartment is desired. Also, combinations to combination locks can be forgotten or misplaced or can fall into the hands of unauthorized persons if the combination is recorded in some manner, such as via a note or in a computer.

The present invention addresses this problem by providing a secret, hidden locking mechanism that is easy for the authorized person to remember and use without the need for any other information or tools, while still providing a secure and hard to discover means of locking and unlocking the compartment against access by unauthorized persons.

SUMMARY OF THE INVENTION

The present invention relates to a hidden locking mechanism for furniture that includes a pivoting locking bar. The bar is pivotally attached to the furniture with one end of the bar provided with a latching hook that engages a hook receiving member of the lock in the lid of the furniture to thereby lock and unlock the lid. An opposite end of the bar is attached to a means for pivoting the bar to thereby move the opposite end of the bar between its locked and unlocked positions.

The means for pivoting the bar is a sliding member and an attached leg of the furniture that can be moved horizontally. When the leg is in its normal position under the furniture, the pivoting locking bar is in its locked position, and when the leg is moved horizontally outward to an extending position located to the side of the furniture, the attached pivoting locking bar is pivoted to its unlocked position.

DETAILED DESCRIPTION OF THE PREFERRED EMBODIMENT

Figure 1:
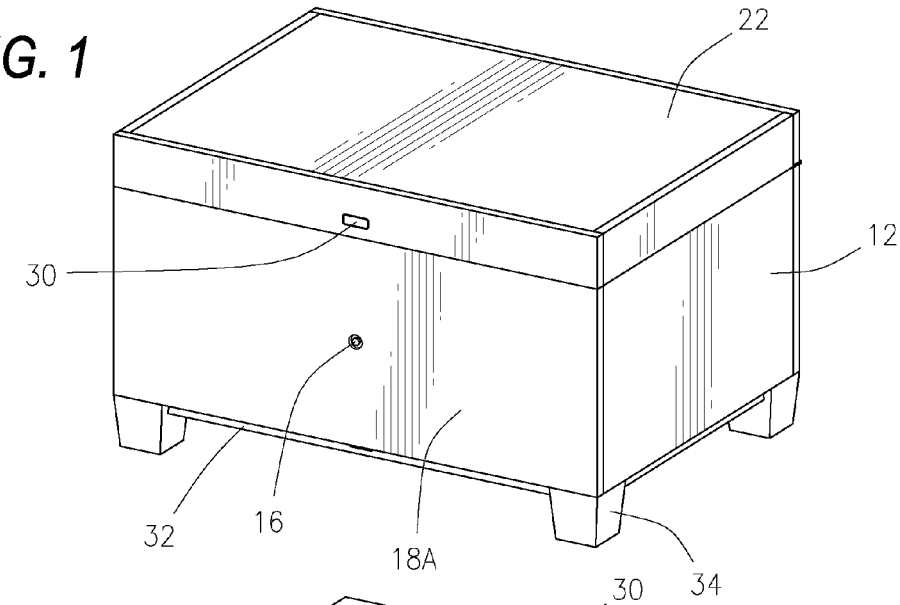
FIG. 1 is perspective view of piece of furniture that includes a hidden locking mechanism according to a preferred embodiment of the present invention, showing the lid and locking mechanism in their locked position.
Figure 2:
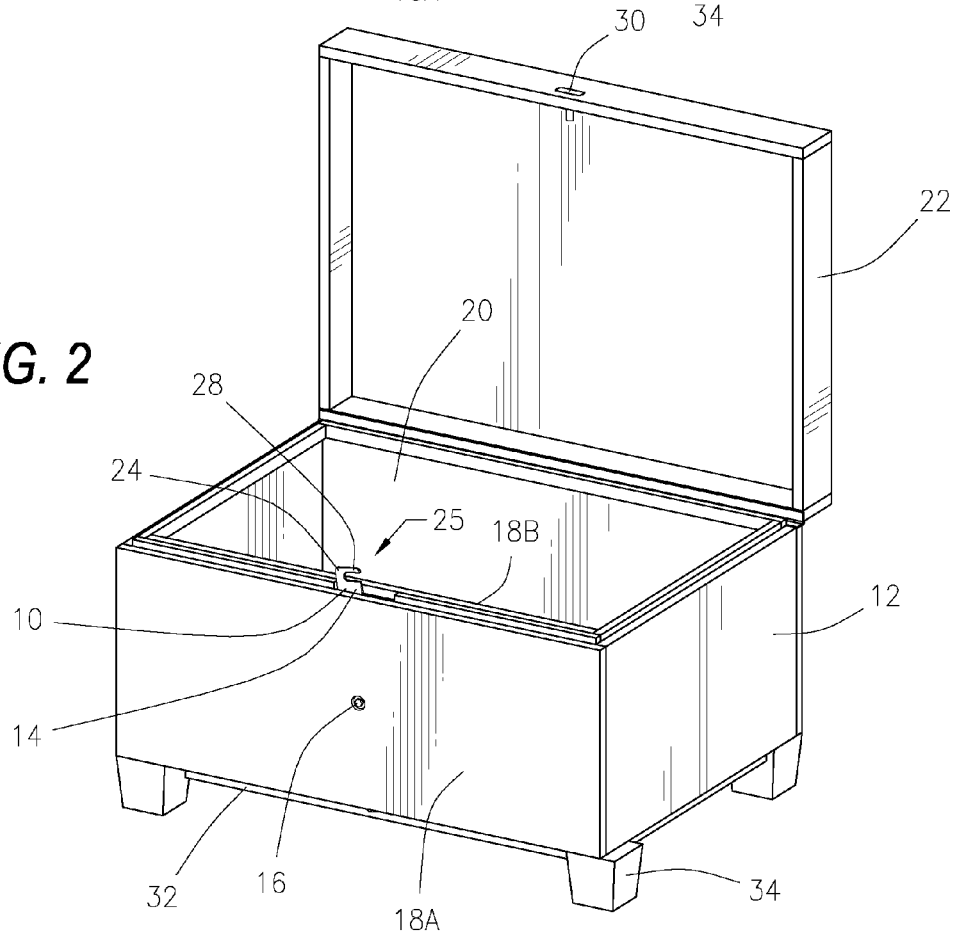
FIG. 2 is view of the furniture of FIG. 1 showing the lid and the locking mechanism in their unlocked position and the lid opened to provide access to a compartment within the furniture.
Figure 3:
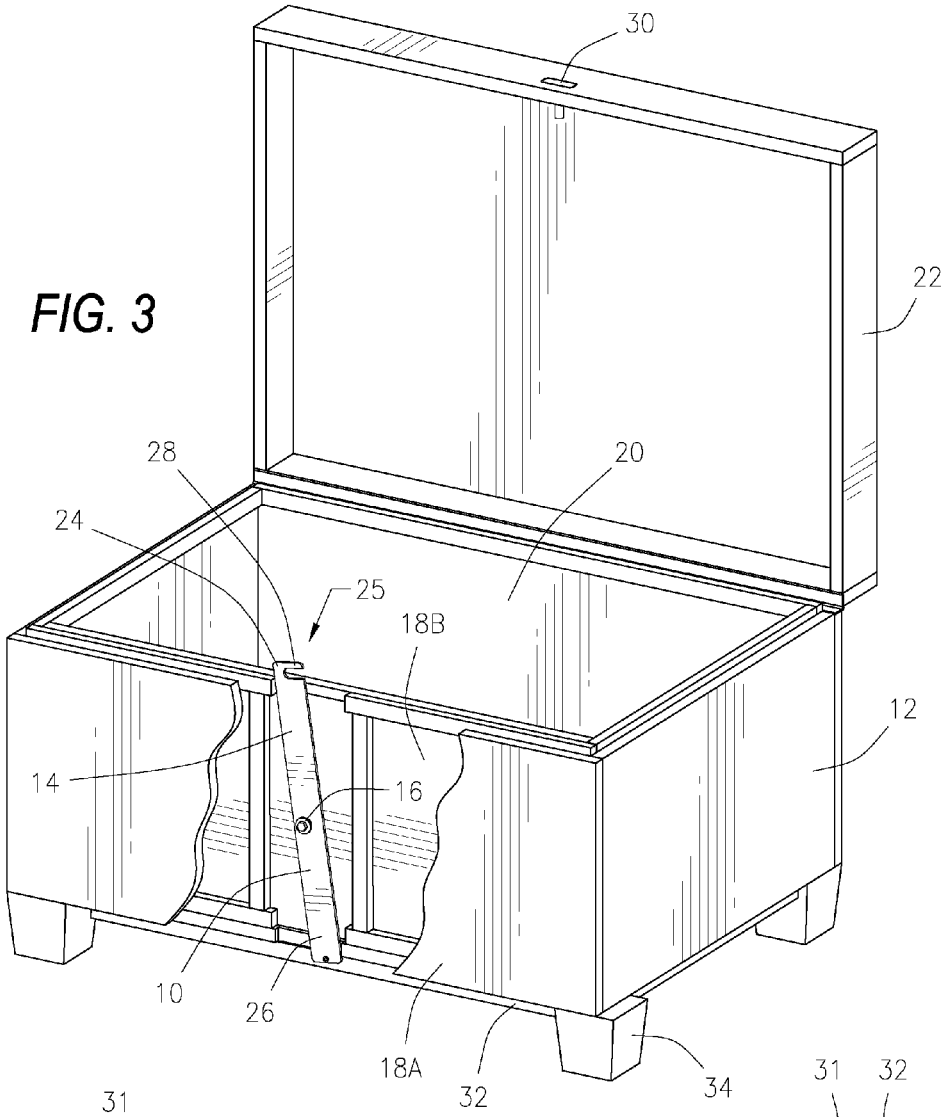
FIG. 3 is a partially cut away view of the furniture of FIG. 2 showing the hidden locking mechanism.

Referring now to the drawings and initially to FIGS. 1, 2, and 3, there is illustrated a hidden locking mechanism 10 for furniture 12 that includes a pivoting locking bar 14 according to a preferred embodiment of the present invention. The bar 14 is pivotally attached to the furniture 12 so that the bar 14 pivots approximately at a pivot point 16 located approximately at a midpoint on the bar 14. The bar 14 is located either between the walls 18A and 18B of the furniture 12 or within a compartment 20 that is provided within the furniture. A hinged lid 22 is provided on the furniture 12 that can be opened to provide access to the compartment 20 and can be closed to secure the compartment 20.

Figure 6:
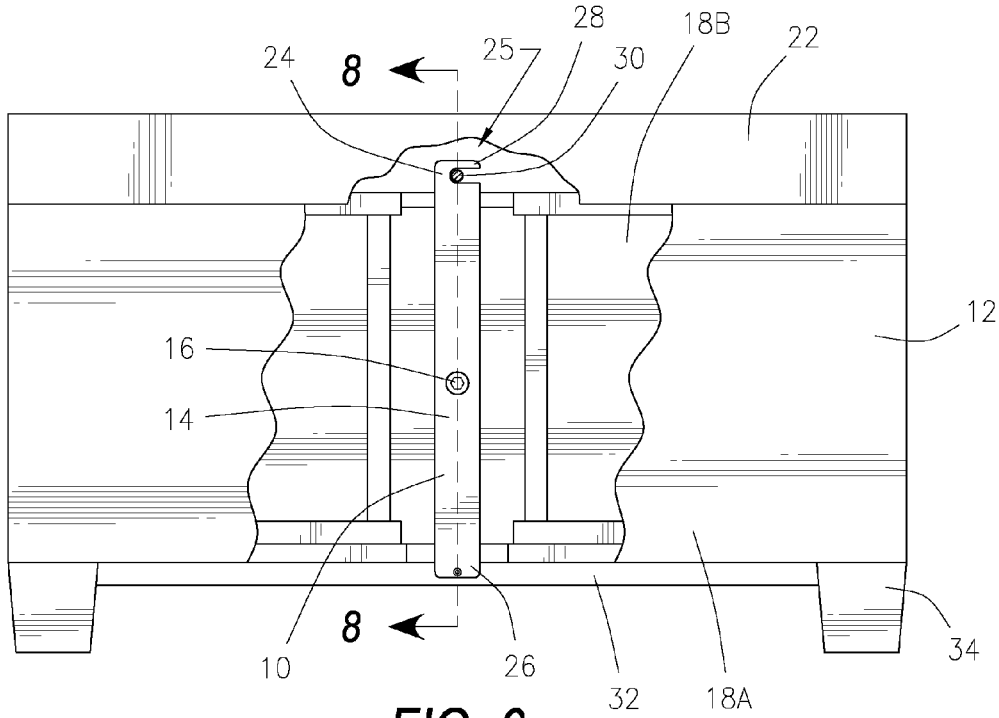
FIG. 6 is a partially cut away front view of the furniture of FIG. 1 showing the hidden locking mechanism in its locked position.
Figure 7:
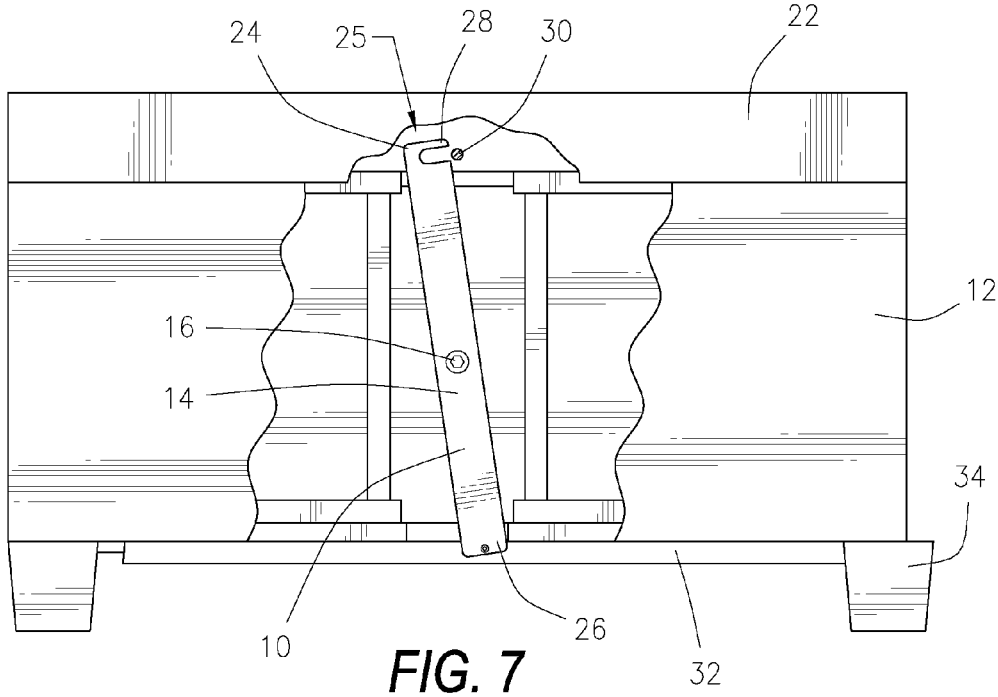
FIG. 7 is a partially cut away front view of the furniture of FIG. 6 showing the hidden locking mechanism in its unlocked position.
Figure 8:
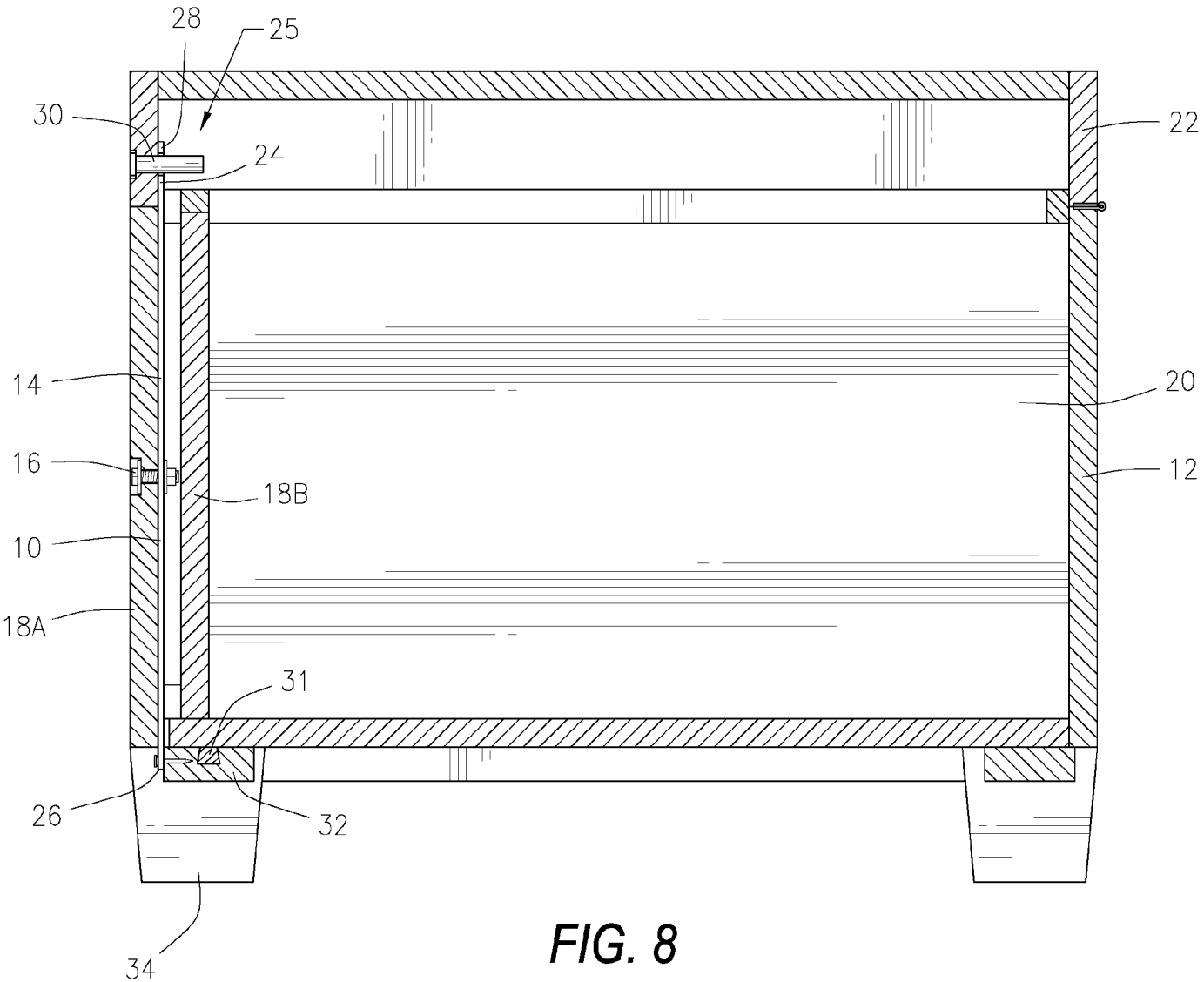
FIG. 8 is a cross sectional view taken along line 8-8 of FIG. 6.

Also referring to FIGS. 6, 7, and 8, the bar 14 has two ends 24 and 26. The free first end 24 of the bar 14 includes one half of a locking mechanism 25 in the form of a latching hook 28 that engages a cooperating second half of the locking mechanism 25 in the form of a hook receiving portion 30 located on the lid 22 of the furniture 12 to thereby either lock or unlock the lid 22 when the two halves 28 and 30 of the locking mechanism 25 are engaged or disengage, respectively, from each other.

The opposite second end 26 of the bar 14 is secured to a means for pivoting the bar 14 and thereby move the first end 24 of the bar 14 between its locked and unlocked positions so the lid 22 is locked when the two halves 28 and 30 of the locking mechanism 25 engage each other in the locked position and so that the lid 22 is unlocked when the two halves 28 and 30 of the locking mechanism 25 disengage each other in the unlocked position.

Figure 4:
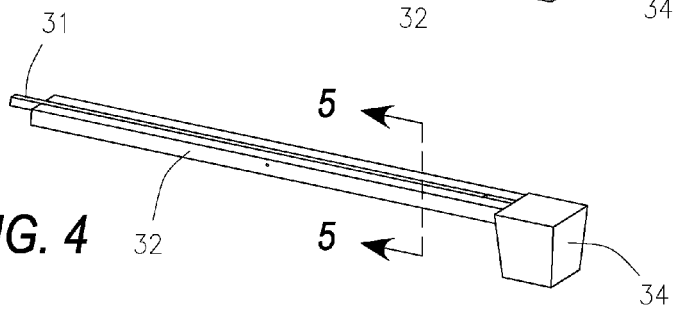
FIG. 4 is a perspective view of the means for pivoting the locking bar consisting of a sliding member that is attached to a movable leg of the furniture and also showing a dovetail piece that has been removed from the bottom of the furniture and on which the sliding member slides.
Figure 5:
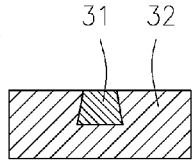
FIG. 5 is a cross sectional view of the sliding member and dovetail piece taken along line 5-5 of FIG. 4.

The means for pivoting the bar 14 is composed of a sliding member 32 that is attached to a leg 34 of the furniture 12. The sliding member 32 is provided with an indented mortise that slides on a wedge shaped extension or tenon of a dovetail piece 31 that is secured to the bottom of the furniture 12. This relationship is best seen in FIG. 4 and in cross section in FIG. 5. The sliding member 32 and the attached leg 34 can be moved horizontally as a unit relative to the furniture 12. When the movable leg 34 is in its normal position under the furniture, the pivoting locking bar 14 is in its locked position where the latching hook 28 is engaged with the hook receiving portion 30 of the lock 25, and when the leg movable leg 34 is moved horizontally outward to an extending position located to the side of the furniture 12, the attached pivoting locking bar 14 is pivoted to its unlocked position where the latching hook 28 is disengaged from the hook receiving portion 30 of the lock 25.

The bar 14 is concealed within the furniture 12, preferably between an outside wall 18A and an inside wall 18B of the furniture 12, or alternately, concealed within the compartment 20 of the furniture 12 so that the bar 14 is not visible from the outside of the furniture 12. Also, the sliding member 32 and attached movable leg 34 appear to be in a fixed and non-movable relationship relative to the furniture 12 when they are located in their normal position so that the locking mechanism 25 is not visible when viewed from the outside of the furniture 12 and the means of opening the lid 22 is not obvious or easily ascertained.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A hidden locking mechanism for a piece of furniture comprising:

a pivoting locking bar, said bar pivotally attached to a piece of furniture between two wall portions of a base portion of the piece of furniture, said base portion having a compartment, with an openable lid provided on the piece of furniture for accessing the compartment, said base portion provided with supporting legs that support the piece of furniture on a supporting surface, a latching hook provided on a free end of the bar, a hook receiving portion located on the lid and engagable by the movable latching hook to thereby lock and unlock the lid with respect to the base portion, and an opposite end of the bar attached to a sliding member provided on the base portion as a means for pivoting the bar to thereby move the latching hook between its locked and unlocked positions relative to the hook receiving portion when the lid is in a closed position with respect to the base portion, said sliding member attached to one of the supporting legs provided on the base portion of the piece of furniture, said supporting leg that is attached to the sliding member being movable horizontally and sideways relative to the base portion of the piece of furniture such that the bar is pivoted to thereby move the latching hook between its locked and unlocked positions relative to the hook receiving portion.

2. A hidden locking mechanism for a piece of furniture according to claim 1 wherein said bar is concealed by the two wall portions of the base portion.

3. A hidden locking mechanism for a piece of furniture according to claim 2 wherein the sliding member and attached movable supporting leg appear to be in a fixed and non-movable relationship relative to the base portion when located in a normal locked position.

4. A hidden locking mechanism for a piece of furniture comprising:

a piece of furniture having a hinged lid that provides access to a compartment located within a base portion of the piece of furniture, said piece of furniture being supported by supporting legs that support the piece of furniture on a supporting surface, a locking bar pivotally attached to the base portion between two wall portions, two ends provided on the bar, one half of a latch mechanism provided on one end of the bar, a cooperating half of the latch mechanism provided on the lid so the lid is locked when the two halves of the latch mechanism engage each other in a locked position and so that the lid is unlocked when the two halves of the latch mechanism disengage each other in an unlocked position allowing access to the compartment, and the other end of the bar secured to a sliding member provided on the base portion, said sliding member attached to one of the supporting legs of the piece of furniture, said supporting leg that is attached to the sliding member is movable sideways relative to the base portion so that the sliding member and movable supporting leg move between a normal position under the base portion where the two halves of the latch mechanism are engaging each other in the locked position and between an extended position where the sliding member and movable leg move horizontally relative to the base portion and outward from a side portion of the base portion from the normal position where the two halves of the latch mechanism are disengaged from each other in the unlocked position.

5. A hidden locking mechanism for furniture according to claim 4 wherein said bar is concealed within the base portion of the furniture.

6. A hidden locking mechanism for furniture according to claim 5 wherein the sliding member and attached movable supporting leg appear to be in a fixed and non-movable relationship relative to the base portion when located in the normal position.

* * * * *